US006182573B1

(12) United States Patent
Richards et al.

(10) Patent No.: US 6,182,573 B1
(45) Date of Patent: Feb. 6, 2001

(54) GRENADE ATTACHMENT SYSTEM

(75) Inventors: Les H. Richards, Temple, TX (US); Roy A. Haggard, Nuevo, CA (US)

(73) Assignee: BAE Systems, Inc., Austin, TX (US)

( * ) Notice: Under 35 U.S.C. 154(b), the term of this patent shall be extended for 0 days.

(21) Appl. No.: 09/183,682

(22) Filed: Oct. 30, 1998

(51) Int. Cl.[7] ..... F42B 39/26

(52) U.S. Cl. ..... 102/275.12; 89/34; 89/35.01; 206/317

(58) Field of Search ..... 89/35.01, 34; 102/275.12; 224/625; 206/3, 317

(56) References Cited

U.S. PATENT DOCUMENTS

| | | | | |
|---|---|---|---|---|
| 1,288,261 | * | 12/1918 | Stimpson | 89/35.01 |
| 1,288,262 | * | 12/1918 | Stimpson | 89/35.01 |
| 1,288,264 | * | 12/1918 | Stimpson | 89/35.01 |
| 1,329,346 | * | 1/1920 | Stimpson | 89/35.01 |
| 1,331,043 | * | 2/1920 | Bangerter | 89/35.01 |
| 2,376,962 | * | 5/1945 | French et al. | 89/35.01 |
| 2,838,543 | | 6/1958 | Randall . | |
| 3,043,399 | | 7/1962 | Marryatt | 182/196 |
| 3,190,514 | * | 6/1965 | Spilman | 224/20 |
| 3,422,925 | | 1/1969 | Petrie | 182/196 |
| 3,710,997 | * | 1/1973 | Asikainen | 248/315 |
| 4,004,491 | * | 1/1977 | Seeling | 89/35.01 |
| 4,693,167 | * | 9/1987 | Bagwell, Jr. | 89/35.01 |
| 4,733,773 | * | 3/1988 | LaBianca et al. | 89/34 |
| 4,882,972 | * | 11/1989 | Raymond | 89/34 |
| 5,945,624 | * | 8/1999 | Becker et al. | 89/34 |

FOREIGN PATENT DOCUMENTS

| | | | | |
|---|---|---|---|---|
| 315256 | * | 11/1919 | (DE) | 89/35.01 |
| 641617 | * | 2/1937 | (DE) | 89/35.01 |

OTHER PUBLICATIONS

Portions of APOBS Technical Data Package; Not For Public Dissemination.
Dated Jan. 16, 1997 but not Publicly Disseminated.

* cited by examiner

*Primary Examiner*—Stephen M. Johnson
(74) *Attorney, Agent, or Firm*—Fulbright & Jaworski, LLP

(57) ABSTRACT

Provided are systems for attaching one or more explosive device(s) to a flexible linear support, related methods and devices, and methods of using the charge assemblies thus produced.

19 Claims, 7 Drawing Sheets

SECTION A-A

SECTION B-B

GRENADE ATTACHMENT SYSTEM

BACKGROUND OF THE INVENTION

1. Field of the Invention

The present invention relates generally to the field of attachment systems. More particularly, it concerns systems for attaching one or more explosive device(s) to a flexible linear support, related methods and devices, and methods of using the charge assemblies thus produced.

2. Description of Related Art

An Anti-Personnel Obstacle Breaching System (APOBS) has been under development for the United States Marine Corps by the Naval Surface Warfare Center (NSWC). The system contains one Rocket Motor, a Line Charge Assembly (LCA) which contains detonating cord and 108 evenly spaced grenades, a single or multiple fuze assemblies, a parachute assembly, two backpack sets, and a shipping container. The APOBS system is designed to clear a safe lane (approximately 0.6–2.0 meters wide by 45 meters long) through wire obstacles containing anti-personnel landmines.

The current LCA design supports the evenly spaced grenades using two parallel 0.25 inch nylon ropes. The grenades are secured to the ropes via twin metal band clamp assemblies. The ropes are designed to be structural members that carry all of the grenade launch and deceleration loads. In addition, the detonating cord running through the center of each grenade is routed with adequate slack to minimize launch induced tensile loads on the cord, i.e., the rope carries the weight of the grenades, grenade attachments, and detonating cord.

Current system grenade attachment specifications prescribe labor-intensive processes that require highly specified and non-standardized components, numerous calibrations and quality checks, and expensive, one-of-a-kind clamping machines. Structural inadequacies, grenade separation and attachment degradations reducing storage life and performance reliability were noticeable problems during the development phase of the APOBS program. The structural support, spacing, and orientation control for the grenades during deployment and impact has also been an area of ongoing concern.

Though the band clamp attachment approach has been demonstrated to adequately support the grenades during deployments, the overall attachment performance and manufacturing processes have proven to be less than satisfactory. A key design feature of the structural attachment mechanism of the band clamp approach was that the clamps allow the ropes to predictability slip under the bands during deployment (shock) loading (2.0 inch slippage maximum). This predictable energy-absorbing rope slippage provided a shock absorption feature that reduced overall loads throughout the line charge assembly. However, the metal clamp edges tended to cut and fray the rope. In addition, the clamping action tended to pinch the outer layer of the dual braided nylon rope allowing only the inner braid to slip under the band—resulting in all the loads being carried by the damaged outer braid—resulting in premature rope failure.

The grenades are stowed in their backpack containers 90° to the direction of deployment, i.e., the ropes are first pulled perpendicular to the grenade axis. After the initial snatch, the grenades align with the deployment direction because the center of gravity of the grenade is behind the forward clamping band. The highest loads are experienced during the initial snatch, and this loading tends to pull the ropes circumferentially under the bands towards the rope pull side of the grenade. This circumferential slippage misaligns the axis of the grenade with the direction of deployment and reduces the maximum load carrying capability of the attachment.

Therefore, an attachment system that prevents rope fraying and misalignment would, among other factors, increase the performance and load carrying capabilities, and would thus represent a significant advance in the art.

SUMMARY OF THE INVENTION

The present invention overcomes these and other limitations present in the art by providing attachment systems that overcome the design and performance limitations present in the explosive device attachments utilizing one or more metal band clamp(s) alone.

The invention provides a system for attaching at least a first explosive device to at least a first flexible linear support, the system comprising at least a first fibrous band operatively connecting the at least a first explosive device to the at least a first flexible linear support. In certain aspects of the invention, the at least a first explosive device is a grenade. In other aspects of the present invention, the at least a first flexible linear support is a rope, a wire, a chain, a cord, webbing or a cable. In certain preferred embodiments, the at least a first flexible linear support is a rope.

In particular aspects of the invention, the at least a first fibrous band comprises a thread or a yarn wound around the at least a first explosive device and the at least a first flexible linear support. In preferred embodiments, the at least a first fibrous band comprises a thread. Threads contemplated for use in the present invention include, but are not limited to, nylon, polyester, polypropylene, Nomex®, Teflon®, Tenara® expanded PFTE, and Kevlar® threads, and blends thereof, for example nylon and Kevlar® threads. In preferred embodiments, the at least a first fibrous band comprises nylon thread. In certain embodiments, the thread is prestressed prior to winding around the at least a first explosive device and the at least a first flexible linear support.

In preferred aspects of the invention, the at least a first fibrous band comprises a thread wound around the at least a first explosive device and the at least a first flexible linear support between about 40 and about 70 times. In particular aspects, the at least a first fibrous band comprises a thread wound around the at least a first explosive device and the at least a first flexible linear support about 45, about 47, about 50, about 53, about 55, about 60, about 64, about 65, about 68 times or any other intermediate value. In other preferred aspects of the invention, the at least a first fibrous band comprises a thread wound around the at least a first explosive device and the at least a first flexible linear support at between about 6 and about 8 pounds of tension. In more preferred aspects, the at least a first fibrous band comprises a thread wound around the at least a first explosive device and the at least a first flexible linear support at about 7 pounds of tension.

In alternative embodiments of the present invention, the at least a first fibrous band comprises a yarn. In preferred embodiments, the at least a first fibrous band comprises Vectran™ yarn. Yarns having various denier values are contemplated for use in the present invention, with yarns of about 1500 denier being particularly preferred. In other preferred aspects, the at least a first fibrous band comprises a yarn with a fiber to resin ratio of about 60:40.

In certain aspects of the invention, the at least a first fibrous band comprises a yarn wound around the at least a first explosive device and the at least a first flexible linear support between about 30 and about 50 times. In particular embodiments, the at least a first fibrous band comprises a yarn wound around the at least a first explosive device and the at least a first flexible linear support about 32, about 35, about 37, about 40, about 43, about 44, about 45, about 46, about 49 times or any other intermediate value. In further aspects, the at least a first fibrous band comprises a yarn wound around the at least a first explosive device and the at least a first flexible linear support at between about 7 and about 9 pounds of tension. In particularly preferred embodiments, the at least a first fibrous band comprises a yarn wound around the at least a first explosive device and the at least a first flexible linear support at about 8 pounds of tension. In still other aspects of the present invention, the at least a first fibrous band comprises a blend, for example a blend of distinct threads, a blend of distinct yarns, or a blend of a thread and a yarn, wound around the at least a first explosive device and the at least a first flexible linear support. In certain aspects of the invention, the at least a first fibrous band has a width of between about 0.3 and about 0.4 inches.

In preferred embodiments of the present invention, the at least a first fibrous band is secured with an adhesive, for example Bostic 812-2. Additional adhesives contemplated for use include, but are not limited to, thermoplastic adhesives, thermoplastic pre-preg adhesives, and quick-drying adhesives, such as cyanacrolate adhesives. A particularly preferred adhesive is super-glue. In other aspects of the invention, shrink tape is used to secure the at least a first fibrous band. Certain of the adhesives contemplated for use in the present invention require a heating step (also referred to as curing). For example, certain adhesives (such as Bostic 812-2) are cured by heating to about 200° F. for about 2, about 3 or about 4 hours or so.

In further aspects of the invention, the system comprises at least a first connector operatively disposed between the at least a first fibrous band and the at least a first flexible linear support. In certain aspects, the at least a first connector defines at least a first trough designed to accommodate the at least a first fibrous band, and also defines a contoured or fluted channel designed to accommodate the at least a first linear support. In other aspects, the at least a first connector further defines at least a first groove designed to accommodate a raised ridge of the at least a first explosive device. In still other aspects, the at least a first connector further defines a contoured or fluted channel having an orifice designed to accommodate a deformed portion of the at least a first linear support as the at least a first linear support passes over the raised ridge of the at least a first explosive device.

In particular embodiments of the invention, the at least a first connector is fabricated from plastic. In preferred embodiments, the at least a first connector is fabricated from Delrin®. In other preferred aspects, the at least a first fibrous band is secured to the at least a first connector with an adhesive. Examples of adhesives contemplated for use in securing the at least a first fibrous band to the at least a first connector include, but are not limited to, epoxy adhesives, such as 2216 epoxy (available from 3M), as well as additional adhesives described herein.

In alternative aspects of the present invention, the system is further defined as a system for operatively attaching at least a first explosive device to at least a first and at least a second flexible linear support. In other aspects, the system is further defined as a system for operatively attaching a plurality of explosive devices to at least a first flexible linear support.

In additional embodiments of the invention, the system further comprises a second band operatively connecting the at least a first explosive device to the at least a first flexible linear support. In preferred embodiments, the system further comprises a second fibrous band operatively connecting the at least a first explosive device to the at least a first flexible linear support.

In still further aspects of the present invention, the system is further defined as a system for operatively attaching at least a first explosive device to at least a first and at least a second flexible linear support, the system comprising at least a first and at least a second fibrous band operatively connecting the at least a first explosive device to the at least a first and at least a second flexible linear support. In yet other aspects, the system is further defined as a system for operatively attaching at least a first explosive device to at least a first and at least a second flexible linear support, the system comprising at least a first and at least a second fibrous band operatively connecting the at least a first explosive device to the at least a first and at least a second flexible linear support, and at least a first and at least a second connector operatively disposed between the at least a first and at least a second fibrous band and the at least a first and at least a second flexible linear support, each of the at least a first and at least a second connectors defining at least a first and at least a second trough designed to accommodate the at least a first and at least a second fibrous band, and also defining a contoured or fluted channel designed to accommodate one of the at least a first and at least a second flexible linear support.

The present invention also provides a system for operatively attaching at least a first explosive device to at least a first flexible linear support, the system comprising at least a first band disposed around and operatively connecting the at least a first explosive device and the flexible linear support, and at least a first connector operatively disposed between the at least a first band and the at least a first flexible linear support. In certain aspects of the invention, the at least a first band is secured to the at least a first connector with an adhesive, exemplified by, but not limited to, an epoxy.

In preferred aspects, the at least a first band is a metal band, or comprises a thread or a yarn. In more preferred aspects, the at least a first band is disposed around the at least a first explosive device and the at least a first flexible linear support at between about 250 and about 350 pounds of tension.

In other embodiments of the present invention, the system is further defined as a system for operatively attaching at least a first explosive device to at least a first and at least a second flexible linear support, the system comprising at least a first and at least a second metal band connecting the at least a first explosive device to the at least a first and at least a second flexible linear support, and at least a first and at least a second connector operatively disposed between the at least a first and at least a second metal band and the at least a first and at least a second flexible linear support, each of the at least a first and at least a second connectors defining at least a first and at least a second trough designed to accommodate the at least a first and at least a second metal band, and also defining a contoured or fluted channel designed to accommodates one of the at least a first and at least a second flexible linear support.

The present invention also provides a line charge assembly, comprising a plurality of explosive devices, at least a first and at least a second flexible linear support, each of the explosive devices operatively attached to the at least a first and at least a second flexible linear support by at least a first and at least a second fibrous band wound around the explosive devices and the at least a first and at least a second flexible linear support, a detonating cord operatively coupled to each of the explosive devices in the line charge assembly, and at least a first fuze assembly disposed at a first end of the line charge assembly. In further aspects, the line charge assembly comprises at least a first and at least a second fuze assembly disposed at a first end and a second end of the line charge assembly, and in still other aspects, the line charge assembly comprises multiple fuze assemblies. In certain aspects of the invention, the line charge assembly further comprises a plurality of connectors, the connectors operatively disposed between the at least a first and at least a second fibrous band and the at least a first and at least a second flexible linear support.

The present invention further provides a line charge assembly, comprising a plurality of explosive devices, at least a first and at least a second flexible linear support, each of the explosive devices operatively attached to the at least a first and at least a second flexible linear support by at least a first and at least a second metal band disposed around the explosive devices and the at least a first and at least a second flexible linear support, a plurality of connectors operatively disposed between the at least a first and at least a second metal band and the at least a first and at least a second flexible linear support, a detonating cord operatively coupled to each of the explosive devices in the line charge assembly, and at least a first fuze assembly disposed at an end of the line charge assembly, or at least a first and at least a second fuze assembly disposed at each end of the line charge assembly.

Additionally, the present invention provides an obstacle breaching system comprising a rocket motor, and a line charge assembly operatively attached to the rocket motor, the line charge assembly comprising a plurality of explosive devices, at least a first and at least a second flexible linear support, each of the explosive devices operatively attached to the at least a first and at least a second flexible linear support by at least a first and at least a second fibrous band wound around the explosive devices and the at least a first and at least a second flexible linear support, a fuze assembly disposed on an end of the line charge or a plurality of fuze assemblies operatively attached to the plurality of explosive devices, and a detonating cord operatively coupled to each of the explosive devices in the line charge assembly.

In certain aspects of the invention, the obstacle breaching system further comprises a parachute assembly operatively attached to the line charge assembly. In further aspects, the obstacle breaching system is comprised within at least a first backpack set. In other aspects, the obstacle breaching system is comprised within at least a first and at least a second backpack set.

In present invention also provides a method of operatively attaching at least a first explosive device to at least a first flexible linear support, comprising winding at least a first fibrous band around the at least a first explosive device and the at least a first flexible linear support. In certain aspects, the method is further defined as a method of operatively attaching at least a first explosive device to at least a first and at least a second flexible linear support. In particular embodiments, the method further comprises winding at least a first and at least a second fibrous band around the at least a first explosive device and the at least a first and at least a second flexible linear support. In other aspects, the method further comprises operably disposing at least a first and at least a second connector between the at least a first and at least a second fibrous band and the at least a first and at least a second flexible linear support.

The present invention further provides a method of operatively attaching at least a first explosive device to at least a first and at least a second flexible linear support, comprising disposing at least a first and at least a second metal band around the at least a first explosive device and the at least a first flexible linear support, and operably disposing at least a first and at least a second connector between the at least a first and at least a second metal band and the at least a first and at least a second flexible linear support.

The present invention also provides a method of deploying a plurality of explosive devices, comprising operably attaching a rocket motor to a line charge assembly and deploying the rocket motor, the line charge assembly comprising a plurality of explosive devices, at least a first and at least a second flexible linear support, each of the explosive devices operatively attached to the at least a first and at least a second flexible linear support by at least a first and at least a second fibrous band wound around the explosive devices and the at least a first and at least a second flexible linear support, a detonating cord operatively coupled to each of the explosive devices in the line charge assembly, and one or more fuze assemblies disposed on the line charge assembly. In certain aspects, the line charge assembly further comprises a plurality of connectors operatively disposed between the at least a first and at least a second fibrous band and the at least a first and at least a second flexible linear support.

Thus, the invention additionally provides a method of deploying a plurality of explosive devices, comprising operably attaching a rocket motor to a line charge assembly and deploying the rocket motor, the line charge assembly comprising a plurality of explosive devices, at least a first and at least a second flexible linear support, each of the explosive devices operatively attached to the at least a first and at least a second flexible linear support by at least a first and at least a second metal band disposed around the explosive devices and the at least a first and at least a second flexible linear support, a plurality of connectors operatively disposed between the at least a first and at least a second metal band and the at least a first and at least a second flexible linear support, a detonating cord operatively coupled to each of the explosive devices in the line charge assembly, and one or more fuze assemblies disposed on the line charge assembly, preferably a fuze assembly disposed at each end of the line charge assembly.

Further, the present invention provides a method of clearing a path of obstacles, comprising deploying an obstacle breaching system over the path, the obstacle breaching system comprising a rocket motor and a line charge assembly operatively attached to the rocket motor, the line charge assembly comprising a plurality of explosive devices, at least a first and at least a second flexible linear support, each of the explosive devices operatively attached to the at least a first and at least a second flexible linear support by at least a first and at least a second fibrous band wound around the explosive devices and the at least a first and at least a second flexible linear support, at least a first fuze assembly disposed on the line charge assembly or a plurality of fuze assemblies operatively attached to the plurality of explosive devices, and a detonating cord operatively coupled to each of the explosive devices in the line charge assembly, thereby clearing the path of obstacles.

In particular methods of the invention, the line charge assembly further comprises a plurality of connectors operatively disposed between the at least a first and at least a second fibrous band and the at least a first and at least a second flexible linear support. In preferred aspects, the obstacles are wire obstacles, such as barbed wire or razor wire, which in certain aspects containing anti-personnel landmines.

Therefore, the present invention also provides a method of clearing a path of obstacles, comprising deploying an obstacle breaching system over the path, the obstacle breaching system comprising a rocket motor and a line charge assembly operatively attached to the rocket motor, the line charge assembly comprising a plurality of explosive devices, at least a first and at least a second flexible linear support, each of the explosive devices operatively attached to the at least a first and at least a second flexible linear support by at least a first and at least a second metal band disposed around the explosive devices and the at least a first and at least a second flexible linear support, a plurality of connectors operatively disposed between the at least a first and at least a second metal band and the at least a first and at least a second flexible linear support, at least a first fuze assembly disposed on the line charge assembly or a plurality of fuze assemblies operatively attached to the plurality of explosive devices, and a detonating cord operatively coupled to each of the explosive devices in the line charge assembly, thereby clearing the path of obstacles.

In accordance with long standing patent law convention, the words "a" and "an" when used in this application, including the claims, denotes "one or more".

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

FIG. 3A. Oblique view of connector 10, defining troughs 20 and 21, fluted channel 35 and groove 48. FIG. 3B. Top view of connector 10, defining troughs 20 and 21, fluted channel 35 and groove 48. FIG. 3C. Side view of connector 10, defining fluted channel 35. FIG. 3D. Cut away side view of connector 10 along A—A axis shown in FIG. 3C, defining troughs 20 and 21, fluted channel 35 and groove 48. FIG. 3E. Cut away side view of connector 10 along B—B axis shown in FIG. 3D, defining fluted channel 35.

FIG. 4A. Static test results of NSWC Technical Data Package (TDP) Band Clamp system. FIG. 4B. Static test results of BRGIC attachment system. FIG. 4C. Static test results of fibrous band whipping attachment. Load (pounds) shown on the vertical axis, extension (inches) shown on the horizontal axis. Static pull tests confirm superior structural capability of the lightweight whipping attachment process.

FIG. 5A. TDP band clamp geometry. Depicted is a banded grenade 20 showing the initial cross-section reduction of the flexible linear supports 30 and 31 (ropes) by band 10. The structural attachment reliability is dependent upon band tension. FIG. 5B. Calculation of band tension. Shown is grenade 20, flexible linear support 30 (rope) and band 10. F, the normal compressive force, is equal to $2T\cos\phi$, where T is the band tension, and $\phi$ is the angle between F. and T.

FIG. 7A. Band Clamp Elongation vs. Tensile Load. Band tension load (pounds) is shown on the vertical axis, elongation (inches) is shown on the horizontal axis. FIG. 7B. Band Clamp Load vs. Percent Elongation. Tensile load (pounds) is shown on the vertical axis, and percent elongation is shown on the horizontal axis. Due to rope creep under the bands, the steel bands cannot provide needed range of elongation to provide reliable attachment over time.

FIG. 8A. Wrap length of 6.803 inches, resulting in no rope compression. FIG. 8B. Wrap length of 6.552 inches (initial compressed state), leading to a 47% cross-section reduction. FIG. 8C. Wrap length of 6.528 inches (final compressed state), leading to a 52% cross-section reduction. FIG. 8D. Wrap length of 6.264 inches (no ropes), leading to a 100% cross-section reduction. FIG. 8E. Graphic representation of the wrap length vs. rope compression from FIG. 8A through FIG. 8D. Wrap length (inches) is shown on the vertical axis, and percentage of cross-section reduction for the rope is shown on the horizontal axis. Rope creep reduces the length of attachment whipping/bands.

DESCRIPTION OF ILLUSTRATIVE EMBODIMENTS

Figure 1:
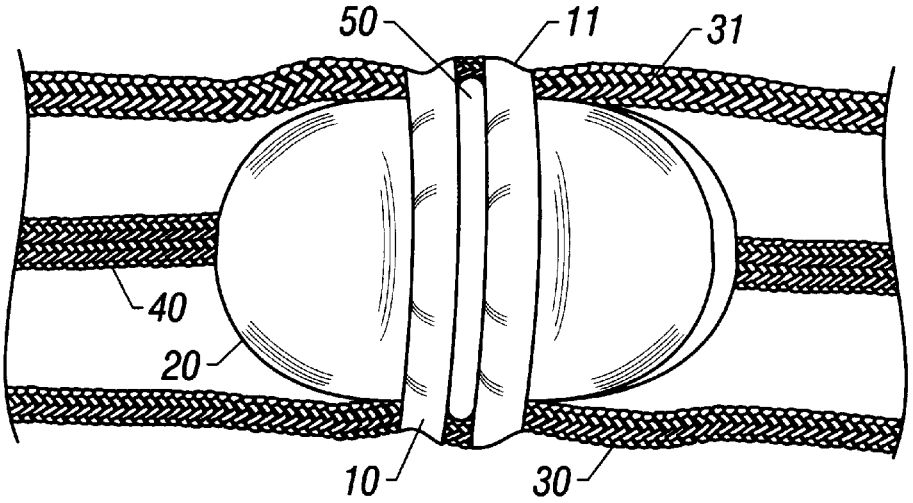
FIG. 1. Schematic representation of an exemplary explosive device-fibrous band attachment. Fibrous bands 10 and 11 are wound around grenade half-shells 20 and 21 and flexible linear supports 30 and 31. Also depicted are detonating cord 40 and grenade shell clamping ring 50.
Figure 2:
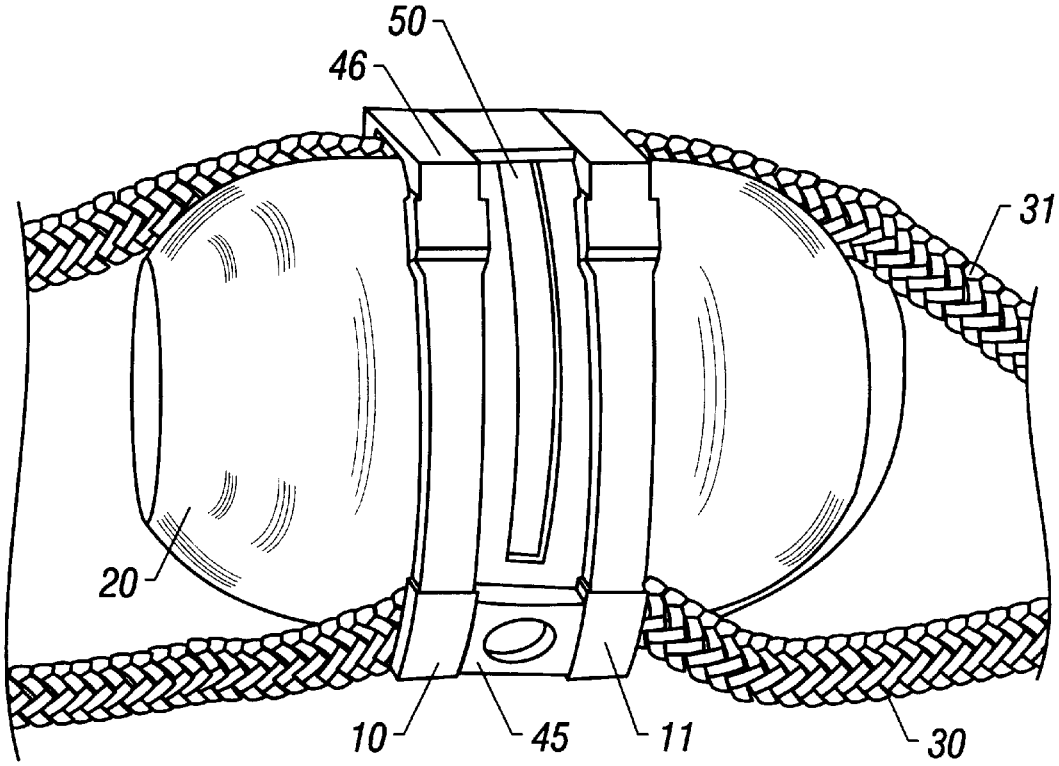
FIG. 2. Schematic representation of an exemplary explosive device-band-rope-grenade interface connector (BRGIC) attachment. Metal bands 10 and 11 are disposed around grenade half-shells 20 and 21 and flexible linear supports 30 and 31. Connectors 45 and 46 are disposed between metal bands 10 and 11 and flexible linear supports 30 and 31. Also depicted is grenade shell clamping ring 50. This representation does not denote a detonating cord, nevertheless, in the context of the invention, one may be utilized as set forth in FIG. 1.
Figure 3A:
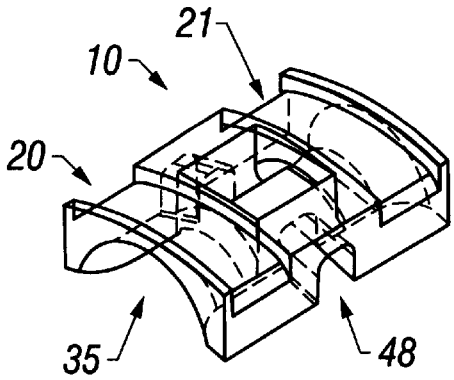
FIG. 3A, FIG. 3B, FIG. 3C, FIG. 3D and FIG. 3E. Schematic views of an exemplary embodiment of a band-rope-grenade interface connector (BRGIC).
Figure 3B:
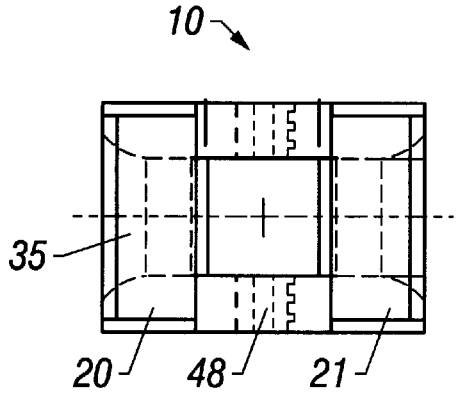
Figure 3C:
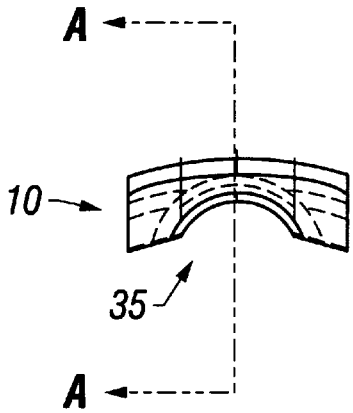
Figure 3D:
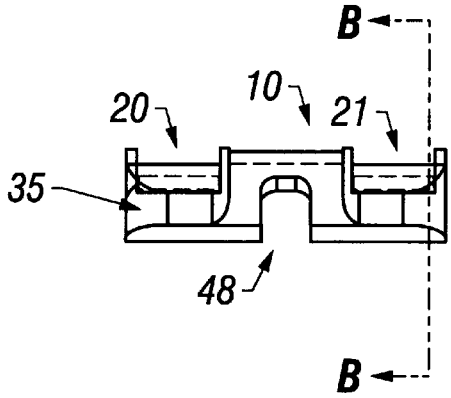
Figure 3E:
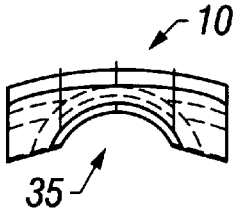

The attachment systems of the present invention overcome the design and performance limitations present in the explosive device attachments utilizing one or more metal band clamp(s) alone. Although the metal band clamp attachment approach has been demonstrated to adequately support an explosive device such as a grenade during deployment, the overall attachment performance and manufacturing processes have proven to be less than satisfactory. Some key issues involving the current attachment approach are presented below.

Among the problems presented by the metal band clamp attachments are: the metal band clamp assemblies are relatively heavy, expensive and require labor-intensive processes, numerous calibrations and quality checks and expensive, one-of-a-kind clamping machines; metal band clamp compression of nylon ropes creates long term storage and structural attachment concerns; the metal band tension decreases due to nylon rope creep weakening the structural attachment; metal bands cut and fray ropes during deployment loading; the metal band clamp mass has been shown to slow fragmentation velocity; and metal band clips and buckles require specific orientation during pack-out and have caused entanglement with parachute deployment.

In order to overcome these and other problems inherent in attachment systems utilizing only one or more metal band clamps, analysis of the metal band clamp manufacturing process and of the functional design was conducted. The manufacturing process analyses provided a baseline for the evaluation of alternative concept processes and provided a baseline model for cost analysis comparisons. The analyses of the functional design included fragmentation modeling to determine the impact of attachment hardware on the fragmentation performance of the explosive device. CTH hydrocode fragmentation analysis (explosive modeling) showed that the extra mass associated with the flanges and clamps caused slower fragmentation. The line charge rocket motor deployment was also analyzed to determine static and dynamic loading, structural attachment requirements, and required margins.

As a result of an extensive analysis, several innovative attachment concepts/processes; were identified. These concepts were further developed and tested to optimize an attachment solution and traded-off against the current metal band only approach (Table 1, below). The concepts were evaluated against the following criteria: form, fit, and function—the size of the attachment should be compatible with the existing backpack volumes; performance—provide a reliable structural attachment, minimize the overall weight to ensure there is no impact to standoff, and ensure the fragmentation performance is not been impacted; automation—the concept should have the potential to be automated to minimize operator presence (safety) and increase producibility; reduction in components—develop approaches or processes that require fewer components; process insensitive—develop reliable, repeatable approaches or processes that require fewer quality checks, calibrations, and validations; and long term storage—the attachment approach should ensure a reliable structural attachment, after exposure to all environments, at any time during the storage or service life of the system.

TABLE 1

| Concept Description | Key Advantages (+)/Disadvantages (−) |
|---|---|
| Technical Data Package (TDP) Configuration: Twin Metal Band Clamps | (+) Demonstrated with Developed Process<br>(−) Process Sensitive to Band Clamp Tension<br>(−) Numerous Set-Ups and Calibrations<br>(−) Hazardous Clamping Operation/Low Potential for Automation<br>(−) Nylon Rope Creep Decreases Band Tension Over Long Term<br>(−) Structural Attachment Concerns During Deployment<br>(−) High Parts Count (540) and Numerous Hand Operations<br>(−) Requires Expensive, One-Of-A-Kind Clamping Machine |
| Whipping Attachment Thread or Yarn Replaces Metal Bands | (+) Reduces System Weight and Packaging Volume<br>(+) Enhances Fragmentation by Elimination of Band Clamps<br>(+) Fully Automated Attachment Process<br>(+) Lowers Production Costs - Reduces Components at Assembly<br>(+) Provides Repeatable and Reliable Structural Attachment<br>(+) Windings Provide Benign Interface to Rope |

TABLE 1-continued

| Concept Description | Key Advantages (+)/Disadvantages (−) |
|---|---|
| | (+) Low Observable Wound Exterior (vs. Shiny Band Clamp)<br>(+) Uses Process Insensitive Assembly Operation<br>(+) Eliminates Long Term Storage Concerns<br>(+) Eliminates Potential Snagging of Parachute with Band Clamps |
| BRGIC With Fibrous Bands | (+) Eliminates Steel Band Clamp Interface to Rope<br>(+) Fluted Connector Provides Contoured Interface to Rope<br>(+) Ropes not Damaged During Compression<br>(+) Fresh Rope Metered through Connector During Loading<br>(+) Eliminates Long Term Storage Concerns<br>(+) Potential for Automation<br>(−) Interface Connector Feature Adds Small Amount of Weight<br>(−) Connector Interferes with Fragmentation Pattern |
| BRGIC With Metal Bands | (+) Eliminates Steel Band Clamp Interface to Rope<br>(+) Fluted Connector Provides Contoured Interface to Rope<br>(+) Ropes not Damaged During Compression<br>(+) Fresh Rope Metered through Connector During Loading<br>(+) Eliminates Long Term Storage Concerns<br>(+) Minimizes Clamping Force Controls and Process Controls<br>(+) Uses Simplified Band Clamps and Clamp machine Tool<br>(−) Interface Connector Feature Adds Small Amount of Weight<br>(−) Metal Bands & Connector Interfere with Fragmentation Pattern |

Certain of the preferred embodiments of the present invention are discussed in greater detail below.

A. Whipping Attachment

In a preferred embodiment, the current invention provides a lightweight attachment system using a fibrous material, such as a yarn or a high strength thread, in a whipping process that lashes the flexible linear support, such as a rope or ropes, to one or both sides of the explosive device, such as one or more grenades. The lightweight attachment system replaces the function of the heavier, more costly, more process sensitive steel band clamps, and provides a more reliable structural attachment with numerous benefits.

The whipping process can be automated providing a low cost, repeatable attachment process. Tests of a preferred embodiment of the present invention have shown consistent results, thus eliminating the need for extensive calibrating and validating tests required when using the metal band clamps alone. The fibrous material presents a benign interface to the linear support (for example nylon ropes), eliminating cutting and fraying experienced with the metal bands alone.

Fibrous materials that exhibit a combination of high elasticity and low creep are particularly preferred for use in the present invention. Thus, although nylon thread is a preferred fibrous material, a number of different fibrous materials are also contemplated for use in particular embodiments of the invention. For example, in one preferred embodiment of the invention, approximately 40–60 wraps of a 1500 denier yarn are used for each whip operation (band), and two whip operations (bands) are used per each grenade attachment (replacing the two steel band clamps). A high tenacity Vectran® yarn has also been tested, and other materials, including, but not limited to, polyester, polypropylene, Nomex®, Teflon®, Tenara® expanded PFTE, and Kevlar® (for example MIL-T-87128 size E) threads, and blends thereof, are also contemplated for use in certain aspects of the invention. Pre-stressed thread is also contemplated for use.

The fibrous material and the ends of the fibrous material, in this embodiment the yarn and yarn ends, are secured in place with an adhesive process (for example pre-preg yarn, adhesive applied during whipping, or applied after whipping). Some of the adhesive processes require slight heating (for example about 3 hours at about 200° F.) for curing. The whipping attachment addresses many of the deficiencies and shortcomings in the art, as described herein.

B. Combined BRGIC—Whipping Attachment

In another aspect of the invention, a specially designed band-rope-grenade interface connector (BRGIC) is utilized with one or more of the fibrous bands described above to provide a benign and predictable interface to the nylon ropes to eliminate rope damage and to provide repeatable energy absorbing slippage during deployment. This configuration allows the connectors to be adhesively bonded to the whipping to eliminate 90° circumferential slipping. The connector allows bonding to the whipping without the adhesive being wicked into the rope, which could weaken the rope. In addition, adhering the connectors to the whipping fixes the connectors in their proper 180° locations maximizing the load carrying ability of the system. Thus, this combined approach has the potential to provide the maximum load carrying capability in applications where this is required.

C. Band-Rope-Grenade Interface Connector (BRGIC)

In another embodiment of the present invention, the band-rope-grenade interface connector (BRGIC) described above is utilized with the metal bands to overcome the shortcomings of using the metal bands alone. The BRGIC approach provides a benign and very predictable rope compression that does not damage the rope during installation or long term storage and yields a repeatable and predictable energy absorbing rope slippage during deployment. The band-to-rope-to-grenade interface connector secures the rope to the grenades via the steel band clamps. The rope interface surfaces of the connector are fluted to provide a very smooth interface to the rope to preclude fraying or pinching. During loading the ropes slip smoothly under the connectors in a very predictable energy absorbing manner.

During 90° testing, the connectors experienced circumferential slippage, reducing their load carrying capability. The circumferential slippage was addressed by adhesively bonding the connectors to the bands clamps, thus fixing the connectors in their respective 180° orientation on either side of the grenade. This approach yielded a configuration capable of carrying very high shock loading while maintaining the desired symmetric rope attachment for optimized deployment load sharing.

The metal band clamp attachment was suspected of causing damage to the ropes during long term storage, and during pull testing it was noted that the ropes were damaged as they slipped under the bands. During testing of the whipping attachment it was noted that the ropes slipped under the yarn whipping in a very repeatable manner without damage to the ropes, however, the whipping did not prevent circumferential slippage during 90° static pull tests. The BRGIC concept provides both a benign interface to the ropes (long term storage concerns) and allows a repeatable energy absorbing slippage of the ropes during loading without causing damage to the ropes. The circumferential displacement of the connector during 90° pull testing was eliminated by bonding the bands to the connectors. This configuration was demonstrated to provide the best overall load carrying capability.

The following examples are included to demonstrate preferred embodiments of the invention. It should be appreciated by those of skill in the art that the techniques disclosed in the examples which follow represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

EXAMPLE 1

Whipping Attachment for Use in the APOBS

In the whipping attachment system for use in the Anti-Personnel Obstacle Breaching System (APOBS), the grenades are attached to the ropes using a whipping or winding process. The whipping attachment process lashes the ropes to the grenades using a fibrous yam or high strength thread eliminating the steel band clamps. An attachment is composed of two separate windings, one on either side of the grenade central clamping ring feature as shown in FIG. 1. Thread tension, number of winds, and winding width are easily controlled. The thread windings are held in place using a quick drying adhesive. The whipping process can be automated providing a low cost, repeatable attachment process. Numerous tests of the concept have shown consistent results eliminating the need for extensive calibrating and validating tests required when using the band clamps. The fibers present a benign interface to the nylon ropes eliminating cutting and fraying experienced with the steel bands. During loading, uncompressed portions of the ropes are pulled smoothly under the windings in a predictable energy-absorbing manner.

The APOBS Technical Data Package (TDP; incorporated herein by reference) is well known to those of skill in the art. As described above, APOBS is a two-man, backpacked system which can breach footpaths through anti-personnel land mines and wire obstacles. The APOBS uses a rocket to pull a line charge over the obstacle. The line charge consists of 108 fragmentation grenades which defeat the obstacle when detonated. Copies of the TDP are available for review via request in writing directed to Marine Corps Systems Command (MARCORSYSCOM), Code CTQIPS, Quantico, Va. 22134-5010.

A presently preferred embodiment uses 60 wraps of a nylon thread (V-T-295 T/2 C/A Size FF) applied with 6–8 pounds tension, secured with a quick drying Cyanacrolate adhesive. The width is controlled to 0.350-inch ±0.050-inch. The whipping attachment is used to secure the ropes to all 108 grenades and four connectors in the line charge assembly. A single spool of nylon thread weighing 0.80 pounds and costing approximately $15.00 replaces the 224 steel bands, 224 buckles, and 108 clips costing approximately $400.00. The total weight of a whipped attachment is less than four grams per grenade, compared to 21 grams per twin metal band clamp assembly, providing a total line charge weight savings of 4.33 pounds.

The whipping attachment provides the following features and benefits: high strength fiber replaces steel bands reducing the line charge weight by 4.33 pounds which allows increased rocket motor standoff performance; the whipping attachment addresses long term storage issues concerning steel band compression of ropes and steel band cutting and fraying of ropes during deployment; nylon thread windings provide a benign interface to rope structure allowing energy-absorbing slippage without rope damage; fragmentation velocity under whipped area is increased due to low mass of fibers vs. high mass steel bands; smooth, low profile whipping attachment eliminates band clamp buckle and clip snagging problems; low observable nylon thread eliminates special finish and surface treatment on steel bands to minimize system visual signature; fully automated whipping process eliminates 224 steel bands and clips, reducing production costs, and provides repeatable and reliable structural attachment eliminating numerous calibration and validation tests, thus lowering production costs; automation of attachment process increases operator safety by removing operator from assembly area; and eliminates orientation of band buckles and clips during pack-out and observed snags of buckles with parachute.

Figure 4B:
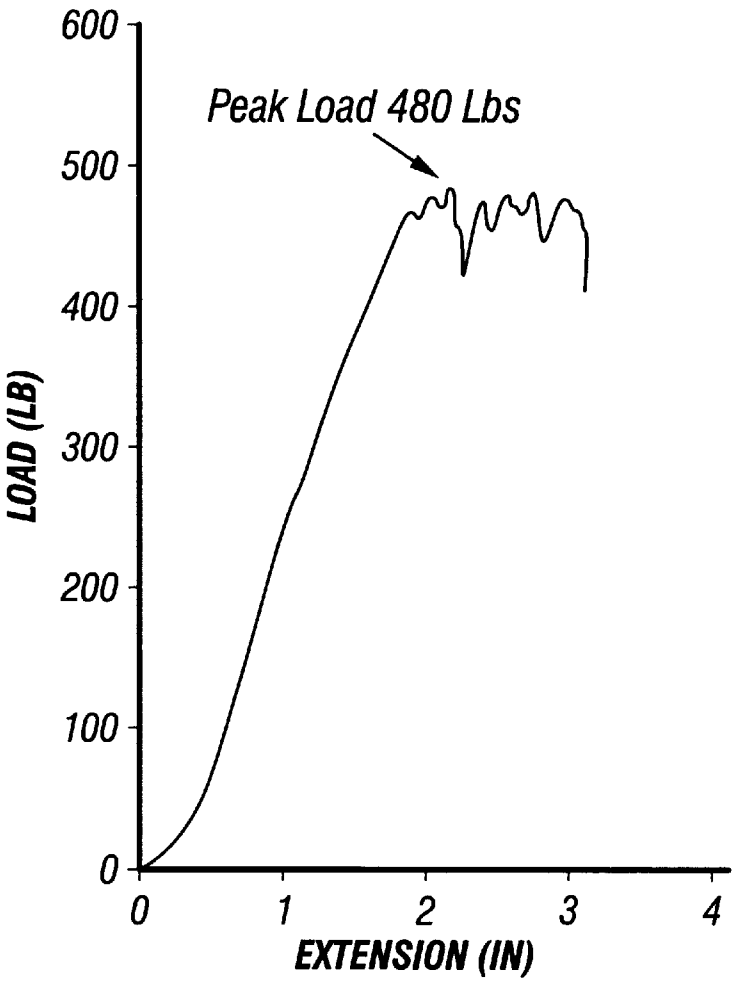
FIG. 4A, FIG. 4B and FIG. 4C. Static test results of attachment systems.
Figure 4A:
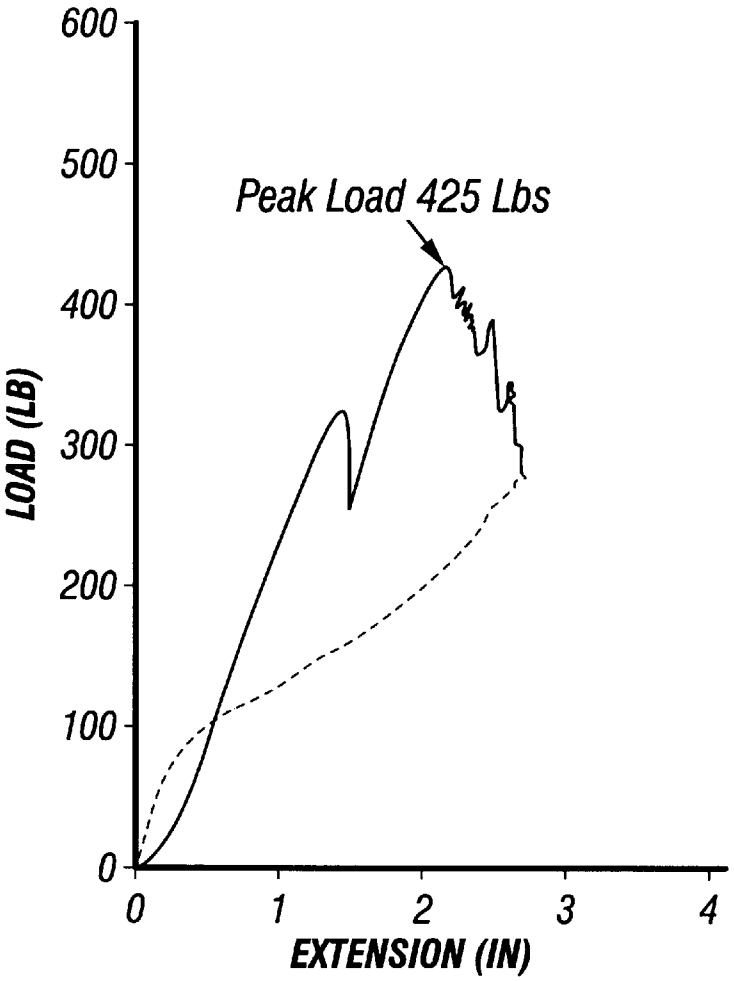
Figure 4C:
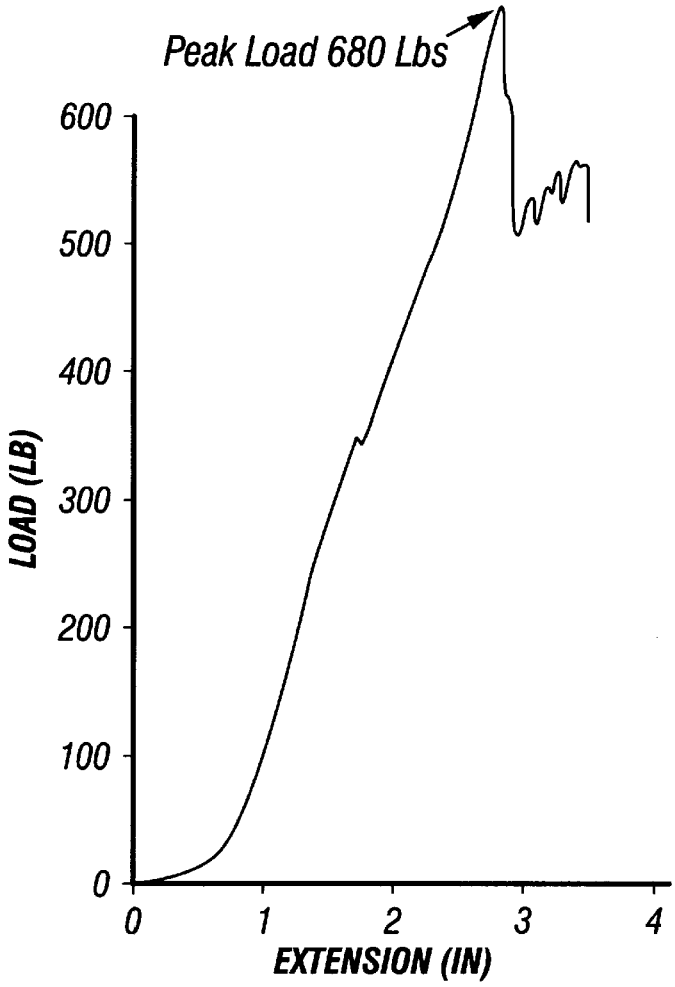

The whipping attachment has been subjected to numerous development tests including thermal cycling, accelerated aging, hot and cold temperature soak, static pull tests (hot, cold, and ambient), and dynamic cold gas cannon tests. The TDP (metal band clamp) zero-degree static pull tests require that the grenade attach sample support a minimum of 250 pounds force before the rope has slipped two inches under the band. The load-extension curve presented in FIG. 4A, FIG. 4B and FIG. 4C shows the typical load carrying capability of the band clamp (FIG. 4A) and the BRGIC (FIG. 4B), and the superior load carrying ability of the whipping attachment (FIG. 4C). It should be noted that all samples tested had been subjected to temperature cycling (70°–160° F.) with high temperature exposure of over 440 hours.

A summary of the whipping static pull tests, demonstrating the superior load carrying after environmental testing, is presented below in Table 2. It is interesting to note that the whipping attachment demonstrated an average peak load capability of 600 pounds at high temperature (+125° F.) testing, 702 pounds at ambient (+70° F.) and 1,057 pounds at cold temperature (−25° F.). In addition, numerous cold gas cannon tests of line charge segments have been performed. Tests have been performed at 110 fps, 120 fps, and 160 fps to demonstrate the structural capability of the whipping attachment. In all of the testing performed on the whipping samples, there has never been any sign of wear or fraying of the rope, and not one grenade has separated nor has a winding ever failed.

TABLE 2

| Test Number | Soak Temp. (° F.) | Test Temp. (° F.) | First Peak Load (lb.) |
|---|---|---|---|
| S-20-0 | +70 | +70 | 646 |
| S-18-0 | +160 | +70 | 680 |
| S-21-0 | +70 | +70 | 703 |
| S-22-0 | +70 | +70 | 705 |
| S-23-0 | +70 | +70 | 925 |
| S-23-0/2 | +160 | +125 | 450 |
| C-01-0 | −65 | −25 | 1200 |
| C-02-0 | −65 | −25 | 914 |
| C-03-0 | +160 | +125 | 689 |
| C-04-0 | +160 | +125 | 660 |

Figure 5A:
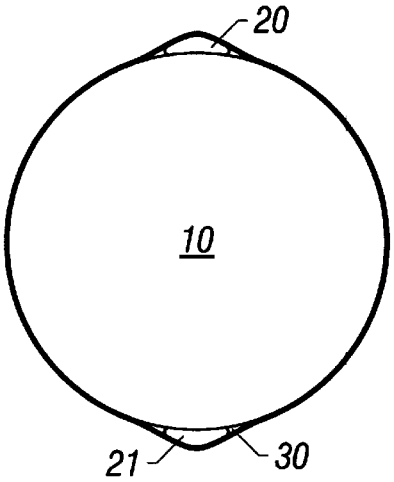
FIG. 5A and FIG. 5B.
Figure 5B:
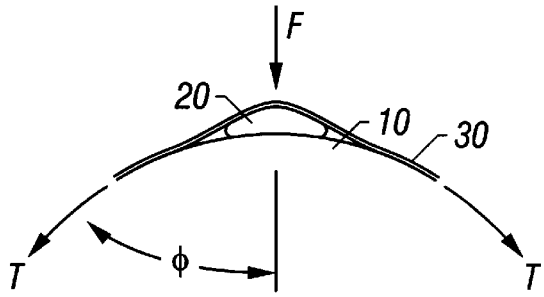

The structural attachment capability of the TDP (metal) band clamp is dependent upon the frictional forces generated between the band, rope, and grenade surfaces. The normal (or compressive) forces that determine these frictional retention forces are a direct result of the tension in the band (FIG. 5B). Government testing has shown that the band clamps can provide the needed clamping forces in the short term; however, testing after long term exposure to elevated temperatures has uncovered serious structural reliability issues due primarily to creep in the nylon ropes (i.e., cold flow of the compressed nylon reduces the rope cross-section under the banded area). The steel band clamp, due to its minimal elongation properties, is incapable of absorbing even small amounts of rope creep and cannot maintain the required clamping force. On the other hand, the instant whipping attachment provides a reliable structural attachment even after the effects of long term aging because the nylon thread material's elastic elongation properties are large compared to the creep in the system.

Figure 6:
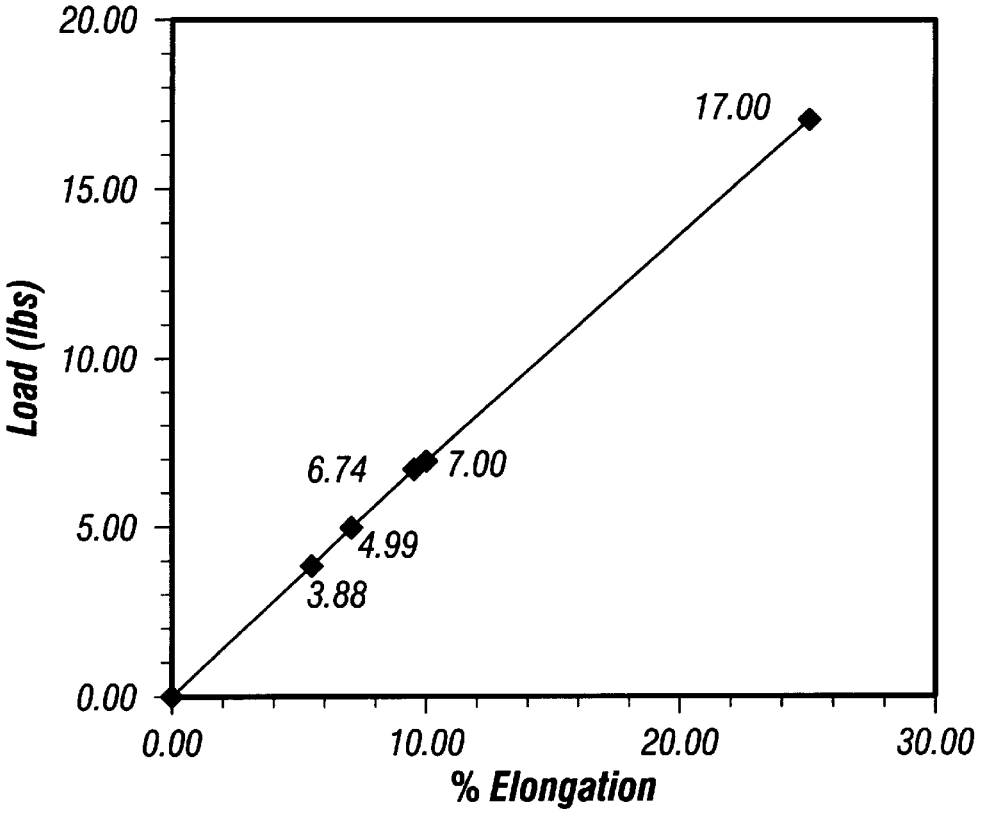
FIG. 6. Elongation of the nylon thread material. Load (pounds) is shown on the vertical axis, and percent elongation is shown on the horizontal axis. The break point of the nylon thread is 17.5 pounds.

The nylon thread is wound around the grenade and ropes under a nominal tension of 7.0 pounds; the thread has a breaking strength of 17 pounds at 25% elongation (FIG. 6). Utilizing 50 wraps, the total wound tension securing the ropes to the grenade is 350 pounds (or 7×50=350), similar to the TDP band clamp installation tension of 250±100 pounds (350 pounds tension used for comparison). During the initial winding of the thread, the nylon rope is compressed from its 0.250 inch circular diameter to a more flattened configuration as shown in FIG. 8B. A similar initial compressed state is achieved during the TDP band clamp installation (FIG. SA).

At 7.0 pounds tension the thread sees an initial elongation of only 10% (or 41% or ultimate, i.e., 7÷17×100=41%; FIG. 6). Given that the nominal wrap length (after initial rope compression) is approximately 6.552 inches (FIG. 8B), a thread length of 5.956 with an elongation of 10% would yield a wrapped length of 6.552 (5.956×1.1=6.552). This elongation represents a delta length of 0.596 inches (or 6.552−5.956=0.596). Conversely, the elongation of the steel band installed at 350 pounds tension is a mere 0.015 inches (FIG. 7A), representing an elongation of only 0.23% (FIG. 7B).

The problem with the TDP band clamp arises during long term aging with a gradual reduction (creep) in the nylon rope cross-section, especially at elevated temperatures (160° F. storage temperature). Experience has shown that, for the design of equipment subjected to sustained loading at elevated temperatures, little reliance can be placed on the usual short-time tensile properties of materials. Under the application of a constant load it has been found that many materials show a gradual flow or creep even for stresses below the proportional limit at elevated temperatures.

However, the compressive loading of the ropes under the whipping or clamps is not constant; as the ropes creep—reducing their cross-section—the tension in the whipping or bands is reduced. The reduced tension reduces the compressive force on the ropes and slows the creep cold flow process. Eventually, a balance is reached. For the steel band clamps, only a small amount of creep results in a relatively large band tension reduction. This is due to the limited elongation capabilities of the steel band with respect to banding length reduction resulting from creep of the rope.

Figure 8A:
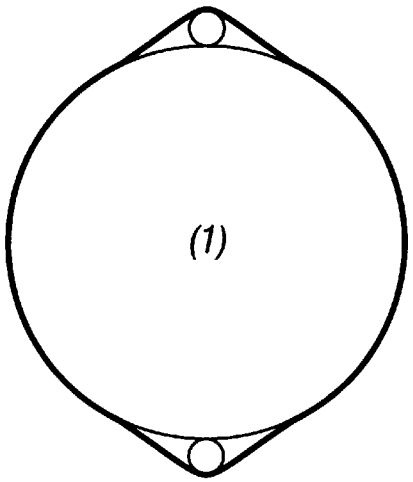
FIG. 8A, FIG. 8B, FIG. 8C, FIG. 8D and FIG. 8E. Depiction of rope compression at various wrap lengths, and a comparison of wrap length vs. rope compression.
Figure 8B:
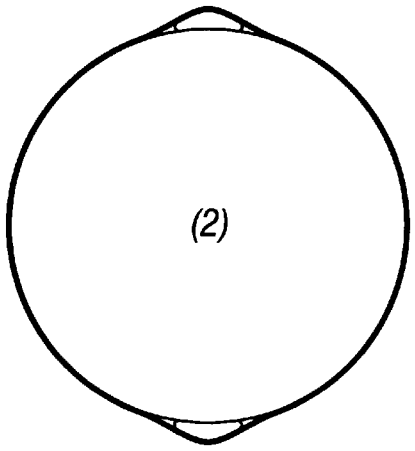
Figure 8C:
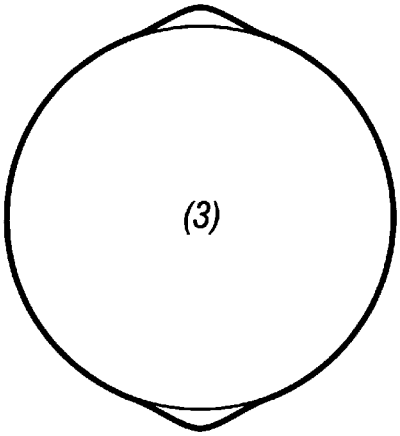
Figure 8D:
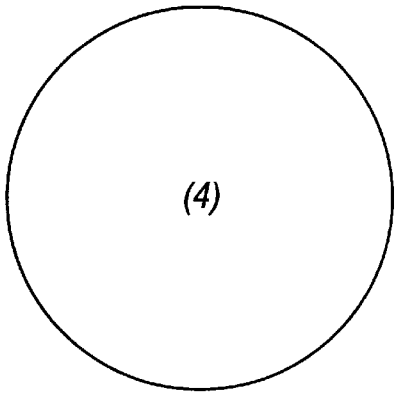
Figure 8E:
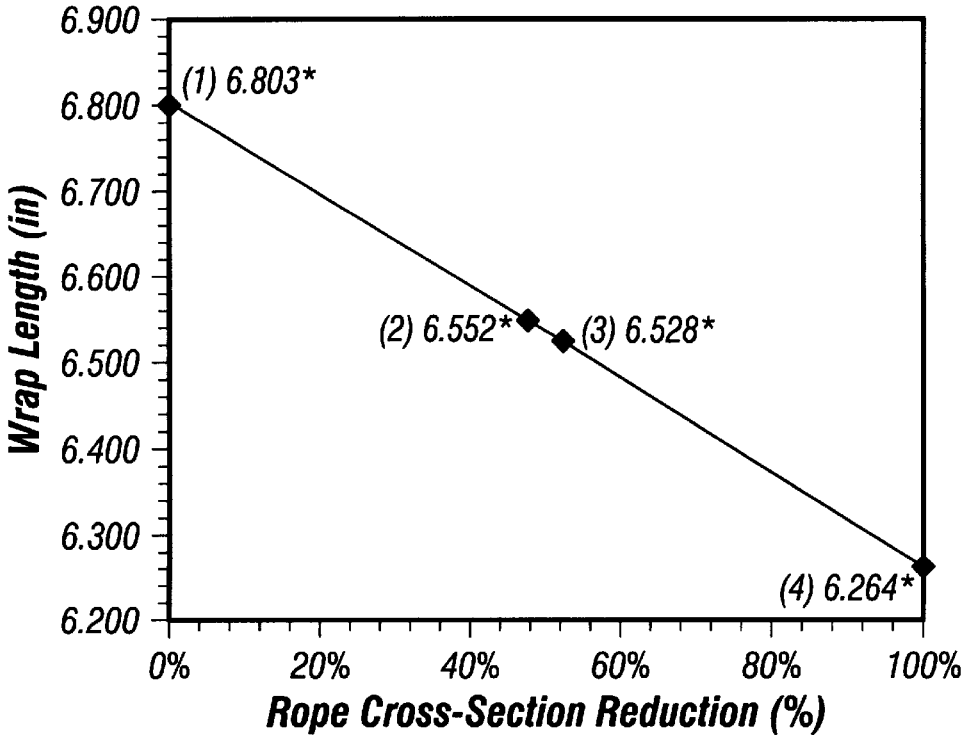

An estimate of rope creep (cross-section reduction over the service life of the system) and the corresponding wrap length reduction has been made (FIG. 8A, FIG. 8B, FIG. 8C, FIG. 8D and FIG. 8E). Four conditions are presented to fully bound the problem as follows: (1) assumes incompressible ropes (i.e., they retain their circular diameter; FIG. 8A); (2) represents an estimate (measured) of the initial compressed state of the rope after the wraps (or bands) are installed (47% compression or flattening of rope; FIG. 8B); (3) an estimate of the maximum cross-section reduction (creep, cold flow) expected during the service life of the system (represents an additional 5% cross-section reduction; FIG. 8C); and (4) assumes 100% reduction, i e., ropes removed (lower bound; FIG. 8D).

The impact of long term aging on the whipping and TDP band clamps can be described as follows. The cross-section reduction in the ropes (from initial installation to the end of service life) reduces the wrap length from 6.552 inches to 6.528 inches or 0.024 inches. This represents an 0.37% reduction in elongation (or thread wrap length, i.e., 0.024+6.552×100=0.37%) reducing the thread percent elongation from 10% to 9.63% and correspondingly reducing the thread tension from 7.0 pounds to 6.74 pounds per wrap (FIG. 6). The overall wrap tension is reduced to 337 pounds (6.74×50=337). It should be noted that the elimination of the ropes altogether (100% cross-section reduction) would only reduce the overall tension in the wraps to 194 pounds (3.88×50=194). This condition could not exist; however, it shows the robustness of the whipping attachment to deal with rope cross-section changes due to creep.

Figure 7A:
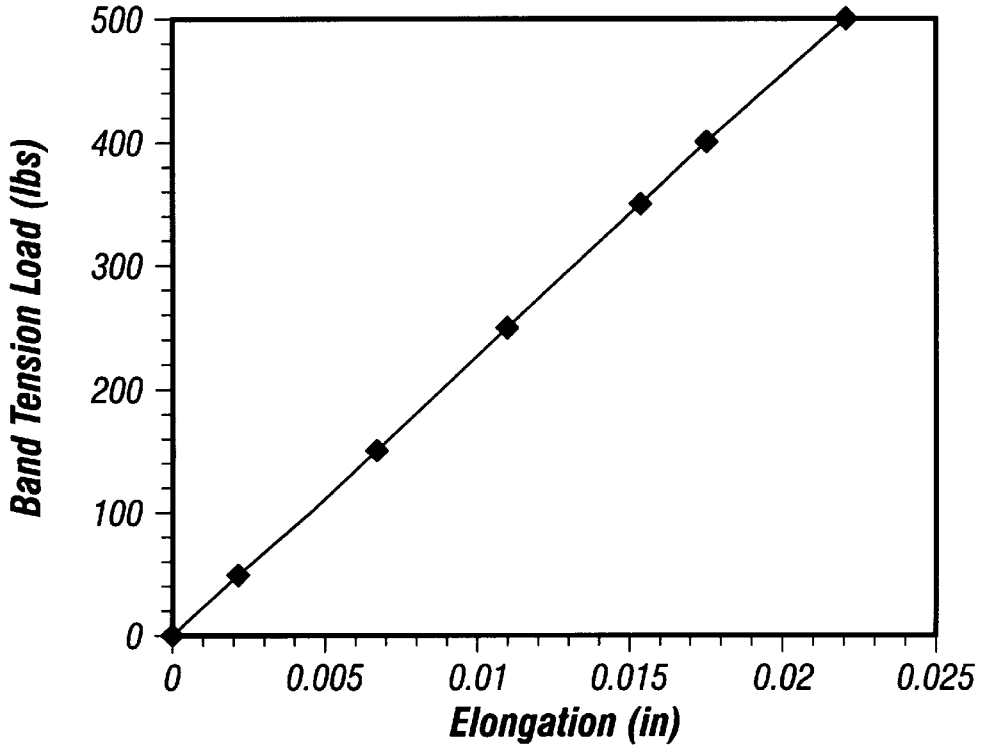
FIG. 7A and FIG. 7B. Comparison of elongation and tensile load for metal band clamps.
Figure 7B:
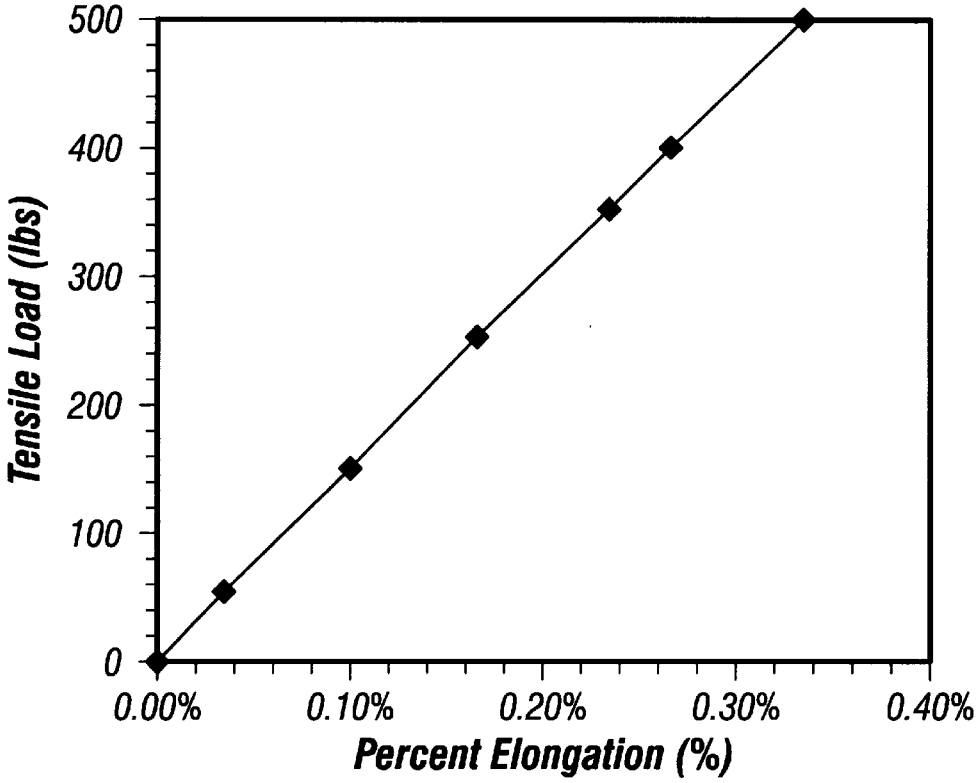

For this example, the identical 0.024-inch reduction in the steel band length (0.37% reduction in elongation) would reduce the tension in the bands to zero (FIG. 7A and FIG. 7B). This, of course, is due to the limited elongation capability of the steel bands, i.e., the bands were originally installed with only 0.23% elongation (0.015-inch elongation).

In actuality, the tension force in the steel bands does not go to zero; a small cross-section reduction in the rope creates a comparatively large initial reduction in the band tension (and compression on the rope). This slows the cold flow process and continued cross-section reduction in the rope; however, the structural integrity of the attachment is not reliable due to the rapid decrease of the compressive attachment forces.

This phenomenon, is the Achilles' heel of the TDP band clamp attachment and it cannot be overcome in the current system. Increases in band tension to compensate for tension loss due to creep only exacerbates the problem. The whipping attachment, on the other hand, is able to address the creep and compensate with its comparatively large elastic elongation properties. The whipped nylon thread has a 40:1 percent elongation advantage over the steel band.

To determine the full impact of creep on the whipping approach, one should also consider the effect of creep in the nylon thread itself Based on the thread properties and tensile loading (5–7 pounds), an additional elongation of the thread of 2.5% over the service life of the system has been assumed. This further reduces the tension in the thread from 6.74 to 5.00 pounds yielding a total wrap tension of 250 pounds (5.0×50=250) which is well within the limits of the TDP tension requirements. Tests of the whipping attachment wound at 5.0 pounds tension have resulted in 0-degree static pull-test peak-load capability in excess of 400 pounds.

The whipping attachment provides a reliable structural attachment even after the effects of long term aging because the nylon thread material's elastic elongation properties are large compared to the creep in the system. The thread, applied at only 41% of its elastic limit, has sufficient elongation to mitigate the effects of long term rope creep, maintaining the clamping force of the attachment. Conversely, the steel band clamp, due to its minimal elongation, is incapable of absorbing even small amounts of rope creep and cannot maintain the required clamping force. Increases in band tension to compensate for tension loss due to creep only exacerbates the detrimental effects (cold flow, cutting and fraying) of the steel bands on the ropes.

In addition, the thread presents a benign interface to ropes, whereas steel bands tend to cut and fray ropes. Tension control is superior with the whipping approach: low, controllable thread winding tension (7±1 pound), and the number of wraps (50) can be accurately controlled; whereas band clamp tension is difficult to control, i.e., reference the large TDP tolerance of 250±100 pounds. The superior structural capability of the whipping attachment was also verified through cold gas cannon tests.

EXAMPLE 2

Grenade Encapsulation

The grenade used in the invention ensures long term storage and detonation reliability, mine neutralization performance, and affordable unit production cost. The current grenade design, when fully detonated, has demonstrated effective anti-personnel (AP) mine neutralization and obstacle clearing performance.

The grenade incorporates booster encapsulation, for example DOA Method-1, to ensure long term reliability and performance. Features of an exemplary grenade design are summarized as follows: 4140 alloy steel shell, with a nominal wall thickness of 0.040 inches, and heat treated to Rockwell C50 to produce fracture and lethal fragmentation at detonation; PBXN-9 main explosive pressed directly into steel shells; PBXN-5 booster explosive, pressed into an aluminum cup (0.008 inch thick 1100-0), capped and sealed with epoxy to maintain a chemical barrier to di-(2-ethylhexyl)-adipate (DOA) plasticizer contamination, which can occur by migration from the PBXN-9; and size and weight envelope of 2.25 inch circumference×3.20 inches length, at 303.3 grams.

This grenade design provides the following features and benefits: employs booster encapsulation to ensure detonation reliability after long term storage; demonstrated blast effects for obstacle clearing and mine neutralization performance; and compatible with automated press loading for efficient assembly and affordable unit production cost.

EXAMPLE 3

Whipping Apparatus

An automated winding machine was developed to facilitate the manufacture of the instant line charges. The machine is configured to allow a continuous flow of grenades and rope to be fed in from one side, lashed together, and pulled out the other side. The grenades and ropes are not rotated during the winding operation. The machine is able to attach at least about 60 to about 108 grenades without reloading thread bobbins or adhesive. It also controls thread tension, number of winds, and width of each winding. Adhesive is applied to secure the thread once the winds are complete. Curing of the adhesive and thread trimming are also controlled.

A semi-automatic winding capability via the development of a prototype winding machine has been demonstrated. The automated grenade attachment winding machine provides continuous grenade attachment with minimal operator presence. Numerous grenade attachments and line charge segments and assemblies have been fabricated and tested demonstrating the reliability of the unique whipping attachment.

As the winding machine should be capable of safely working with high explosive grenades, operator involvement was minimized. The machine, or machine and a single operator, has the following capabilities: loading of the grenades on insertion tool; insertion of grenade into winding machine; storing, routing and tensioning of the ropes, positioning of the ropes with respect to the grenades; control of rope twist; starting of thread winding (initial securing of the thread); lashing the ropes to the grenade via a controlled number of winds; controlling the width and lay-down pattern of the windings; application of adhesive to the thread windings; adhesive curing; cutting the end of the thread; advancing the attached grenade; and insertion of the subsequent grenade (to be attached) at the proper spacing.

The grenades may be supported through their center during handling and attachment (detonating cord not present during attachment). The preferred grenade to grenade spacing is between about 16 and about 16.5 inches along the ropes. The ropes should be located at about 180°±10° on either side of the grenade longitudinal axis. Minimal twist in either rope is preferred. The ropes are manufactured with a continuous red stripe down one side and are secured to the grenades in such a manner that this stripe is radially out on both sides of the grenade with minimal twist between subsequent grenade attachments. Approximately 5 pounds tension in the rope should be maintained during attachment. The width of each individual attachment winding is approximately 0.3–0.4 inches.

The automated whipping machine allows continuous attachments at a rate of one every five minutes. The whipping head rotates at 3 rps allowing the whipping operation to be completed in approximately 35 seconds, however, the hand insertion and clamping of the grenades, rope positioning and tensioning, thread starting, adhesive application, and thread trimming are all done manually. The unclamping and advancement of the whipped grenade to the forward (spacing) position is also a hand operation limiting the throughput of the prototype machine to five minutes per grenade. This is a significant improvement over the 15 minutes required with a hand-operated machine.

The consistency of the attachments from the prototype automated winding machine can be seen in the first article (FA) samples (Table 3). All samples were wound with 50 wraps. The data clearly shows that the load capacity of the attachment is repeatable and can be easily adjusted by changing the number of wraps.

TABLE 3

| 0-Deg Test No. | Test Date | Soak Temp (° F.) | Test Temp (° F.) | 1st Peak Load (lb.) |
|---|---|---|---|---|
| FA-01-0 | 04-20-98 | +70 | +70 | 485 |
| FA-02-0 | 04-20-98 | +70 | +70 | 509 |
| FA-03-0 | 04-20-98 | +70 | +70 | 406 |
| FA-04-0 | 04-21-98 | +70 | +70 | 456 |
| FA-05-0 | 04-21-98 | +70 | +70 | 480 |
| FA-06-0 | 04-21-98 | +70 | +70 | 479 |
| FA-07-0 | 04-21-98 | +70 | +70 | 428 |
| FA-08-0 | 04-21-98 | +70 | +70 | 457 |
| FA-09-0 | 04-21-98 | +70 | +70 | 432 |
| FA-10-0 | 04-21-98 | +70 | +70 | 468 |

The low-tension application of the thread during attachment was determined to be a much safer operation than the high-tension application of the band clamps. Machine requirements are summarized in Table 4.

TABLE 4

| Component | Machine Requirement |
|---|---|
| Grenades/Connectors | Spacing, Loading On Insertion Tool, Insertion Into Winding Head, And Post Whipping Advancement. |
| Rope | Storing, Routing, Tensioning, Positioning, And Twist Control. |
| Nylon Thread | Storage, Initial Securing, Whipping, Number Of Winds, Lay-Down Pattern, And Trimming. |
| Adhesive | Application And Curing. |

A preferred setup utilizes two automated whipping machines with the capability of one attachment every minute. Achieving one grenade per minute can be accomplished by increasing the winding head speed to 5 rps, thus reducing whipping time to 20 seconds. That allows 40 seconds for automated grenade loading, advancing, thread handling and adhesive application. The availability of two machines provides backup production capability in the event that one of the machines was down or during periodic maintenance. In addition, the use of two machines allows a lower level of complexity and automation, reducing machine development time, risk, cost, and maintenance.

All of the compositions and methods disclosed and claimed herein can be made and executed without undue experimentation in light of the present disclosure. While the compositions and methods of this invention have been described in terms of preferred embodiments, it will be apparent to those of skill in the art that variations may be applied to the compositions and methods, and in the steps or in the sequence of steps of the methods, described herein without departing from the concept, spirit and scope of the invention. More specifically, it will be apparent that certain agents which are related may be substituted for the agents described herein while the same or similar results would be achieved. All such similar substitutes and modifications apparent to those skilled in the art are deemed to be within the spirit, scope and concept of the invention as defined by the appended claims.

What is claimed is:

1. A system for attaching at least a first grenade to at least a first flexible linear support, said system comprising at least a first fibrous band operatively connecting said at least a first grenade to said at least a first flexible linear support, wherein at least a second grenade is connected to the first flexible linear support and wherein said first grenade and said second grenade are coupled to a detonating cord.

2. The system of claim 1, wherein said at least a first flexible linear support is a rope.

3. The system of claim 1, wherein said at least a first fibrous band comprises a thread or a yarn wound around said first grenade and said at least a first flexible linear support.

4. The system of claim 3, wherein said at least a first fibrous band comprises a thread.

5. The system of claim 4, said at least a first fibrous band comprises nylon thread.

6. The system of claim 4, wherein said at least a first fibrous band comprises a thread wound around said first grenade and said at least a first flexible linear support, wherein said thread is wound between about 40 and about 70 times.

7. The system of claim 4, wherein said at least a first fibrous band comprises a thread wound around said first grenade and said at least a first flexible linear support, wherein said thread is wound at between about 6 and about 8 pounds of tension.

8. The system of claim 1, wherein said at least a first fibrous band has a width of between about 0.3 and about 0.4 inches.

9. The system of claim 1, wherein said at least a first fibrous band is secured in place with an adhesive.

10. The system of claim 1, further comprising at least a first connector operatively disposed between said at least a first fibrous band and said at least a first flexible linear support.

11. The system of claim 10, wherein said at least a first connector is fabricated from plastic.

12. The system of claim 10, wherein said at least a first fibrous band is secured to said at least a first connector with an adhesive.

13. The system of claim 1, further defined as a system for operatively attaching said first grenade to said at least a first flexible linear support and at least a second flexible linear support.

14. The system of claim 1, further defined as a system for operatively attaching a plurality of explosive devices to said at least a first flexible linear support.

15. The system of claim 1, further comprising a second fibrous band operatively connecting said first grenade to said at least a first flexible linear support.

16. The system of claim 1, further defined as a system for operatively attaching said first grenade to said at least a first flexible linear support and at least a second flexible linear support, said system comprising said at least a first fibrous band and at least a second fibrous band operatively connecting said first grenade to said at least a first and at least a second flexible linear support.

17. A system for operatively attaching at least a first grenade to at least a first flexible linear support, said system comprising at least a first band disposed around and operatively connecting said at least a first grenade and said flexible linear support, and at least a first connector operatively disposed between said at least a first band and said at least a first flexible linear support, wherein at least a second grenade is connected to the first flexible linear support and wherein said first grenade and said second grenade are coupled to a detonating cord.

18. The system of claim 17, wherein said at least a first band is a metal band or comprises a thread or a yarn.

19. A method of operatively attaching at least a first grenade to at least a first flexible linear support, comprising winding at least a first fibrous band around said first grenade and said at least a first flexible linear support and wherein at least a second grenade is connected to the first flexible linear support and wherein said first grenade and said second grenade are coupled to a detonating cord.

* * * * *

UNITED STATES PATENT AND TRADEMARK OFFICE

CERTIFICATE OF CORRECTION

PATENT NO. : 6,182,573 B1
DATED : February 6, 2001
INVENTOR(S) : Les H. Richards and Roy A. Haggard It is certified that error appears in the above-identified patent and that said Letters Patent is hereby corrected as shown below:

Title page,
Item [73], delete "BAE Systems, Inc., Austin TX (US)" and insert therefor -- Marconi Aerospace Defense Systems, Inc., Austin, TX (US); Vertigo, Inc., Lake Elsinore, CA (US) --.

Claim 5,
Line 56, before "said", insert -- wherein --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,182,573 B1 
DATED : February 6, 2001
INVENTOR(S) : Les H. Richards and Roy A. Haggard It is certified that error appears in the above-identified patent and that said Letters Patent is hereby corrected as shown below:

Title page,
Item [73], Assignee, delete "Marconi Aerospace Defense Systems, Inc., Austin TX (US)" and insert therefor -- BAE SYSTEMS Integrated Defense Solutions Inc., Austin, TX (US) --.

Signed and Sealed this

Eighth Day of November, 2005

JON W. DUDAS
*Director of the United States Patent and Trademark Office*